US005603121A

United States Patent [19]

Borkovic et al.

[11] Patent Number: 5,603,121

[45] Date of Patent: Feb. 18, 1997

[54] INFINITELY ADJUSTABLE BASEBALL-TYPE CAP

[76] Inventors: Michael A. Borkovic; Cameron N. Borkovic; George M. Borkovic, all of P.O. Box 281, Philomont, Va. 22131

[21] Appl. No.: 608,613

[22] Filed: Feb. 29, 1996

[51] Int. Cl.[6] ..... A42B 1/22

[52] U.S. Cl. ..... 2/195.2; 2/183; D2/881

[58] Field of Search ..... 2/183, 195.2, 209.4, 2/417, 418, 420; D2/874, 877, 880, 881, 884

[56] References Cited

U.S. PATENT DOCUMENTS

| | | | |
|---|---|---|---|
| D. 110,834 | 8/1938 | Getman et al. | D2/877 |
| D. 350,847 | 9/1994 | Thomas | D2/881 |
| D. 365,917 | 1/1996 | Armstrong | D2/881 |
| 1,097,255 | 5/1914 | Muhlfeld . | |
| 1,211,075 | 1/1917 | Burns . | |
| 1,824,840 | 9/1931 | Ruffing, Sr. | 2/195.2 |
| 2,106,570 | 1/1938 | Lipton . | |
| 2,356,042 | 8/1944 | Ferber . | |
| 2,925,606 | 2/1960 | De Grazia | 2/195.2 |
| 5,450,629 | 9/1995 | Gilstrap . | |

*Primary Examiner*—Diana Biefeld

*Attorney, Agent, or Firm*—Sughrue, Mion, Zinn, Macpeak & Seas

[57] ABSTRACT

A baseball-type cap has a shell of general hemispherical shape within an open bottom. A visor is attached along a peripheral inner edge to the shell at the front of the shell. An arcuate inwardly and upwardly tapered opening is provided within the shell diametrically opposite the visor. A chord or other lace is looped through the holes within grommets attached to the shell at the corners of the shell at the rear opening proximate to the peripheral edge at the bottom of the shell and free ends of the lace are tied preferably in a bow, permitting infinite circumferential size adjustment of the shell to conform the shell to the head of a wearer.

4 Claims, 1 Drawing Sheet

INFINITELY ADJUSTABLE BASEBALL-TYPE CAP

FIELD OF THE INVENTION

This invention relates to a new and improved baseball-type cap, and more particularly to a simplified infinite adjustment of a hemispherical shell forming a principal component of the cap in the form of a looped drawstring having free ends tied together in a bow.

DESCRIPTION OF THE PRIOR ART

A popular form of hat is the baseball-style cap formed of a hemispherical shell having a visor attached along a bottom edge of the shell at the front of the cap to shade the eyes of the wearer. Typically, such baseball-style caps have an adjustment system along the edge of the shell to change the circumferential size of the shell periphery to match that of the wearer's head. Attempts have been made to vary the hat opening size of hats in general over the years.

U.S. Pat. No. 1,097,255 to Frank J. Muhlfeld, issued May 19, 1914 and entitled "TONGUED REDUCER FOR LARGE CROWNED HATS" provides an adjustable size hat via a hat-opening with a series of yielding projections or tongues extending inwardly towards the center of the head opening as a circumferential series about the head and adapted to yield separately when fitted to the head of the user.

U.S. Pat. No. 1,211,075 to Mary A. Burns, issued Jan. 2, 1917 and entitled "WOMAN'S HAT BANDING" provides a lining for a hat comprised of a flexible strip of material having one marginal portion secured to the crown of the hat and an offset longitudinal margin provided with a hem, with a cord extending about the crown of the hat having its free ends knotted together in the form of a bow.

U.S. Pat. No. 2,356,042 to Hyman Ferber, issued Aug. 15, 1994 and entitled "COMBINATION NON-ELASTIC ADJUSTABLE HATBAND AND BOW TRIM HAT" employs a V-shape within a side of a pancake type crown with a pair of straps emanating at the sides of the opening and being tied together by a bow.

U.S. Pat. No. 2,106,570 to Ruby Lipton, issued Jan. 25, 1938 and entitled "HEAD COVERING" employs a similar approach to that of Ferber, while adding a buckling or folding tongue sized larger than the side opening in the crown for variably closing off the opening during adjustment of the crown to the head of the user.

U.S. Pat. No. 5,450,629 to Keith D. Gilstrap, issued Sep. 19, 1995 and entitled "CONVERTIBLE HAT WITH FOLDABLE VISOR AND ASSOCIATED METHOD" provides a hat of the baseball-type having a shell of generally hemispherical shape with an opening bottom. A crescent shaped foldable visor is attached to the peripheral edge of the shell opposite the opening with the fold lines and the visor, permitting the visor to be folded to reduce its size and to tuck the visor into the interior of the hat to form a purse. In one form, a pair of drawstrings are integrated into an arcuate band at the bottom of the shell, with the free ends extending into the opening and passing through a friction ring, permitting the bottom of the shell to be adjusted to the size of the head of the user.

Predominantly in recent years, the size adjustment of hats, and particularly baseball-style caps, have utilized overlying plastic strips fixed at one end to respective opposite sides of the hemispheric shell with respective strips carrying spaced projecting pegs and holes. However, the pegs, the holes and the plastic strips themselves are subject to breakage while limiting the adjustability feature to the spacing between pegs and holes.

It is therefore a primary object of the present invention to provide an improved baseball-type cap whose size is essentially infinitely adjustable, which is virtually unbreakable, which offers a plethora of creative opportunities with respect to the material and configuration of a lace, looped through a pair of eyelets fixed to the cap shell along the bottom of the shell and at opposite sides of the opening within the rear of the shell permitting infinite adjustment of the shell size by tying the free ends of the lace into a bowknot.

SUMMARY OF THE INVENTION

The invention is directed to a baseball-type hat comprised of a hemispherical shell having a front, a rear, a top and a bottom and a peripheral bottom edge. A crescent-shaped visor is attached to the shell along the shell peripheral edge at the front of the shell so as to extend perpendicularly, outwardly of the peripheral edge. The visor extends from one side of the shell to another opposite side. An inwardly and upwardly tapered opening is provided within the shell at the rear and extends from the bottom of the shell towards the top. A lace is looped through grommets fixed within the shell to opposite sides of the rear opening proximate to the peripheral edge of the shell. The free, opposite ends of the lace are tied together, preferably via a bow-type knot, thereby permitting an infinite circumferential size adjustment of the shell to conform the shell to the head of a wearer.

DESCRIPTION OF THE PREFERRED EMBODIMENT

Figure 1:
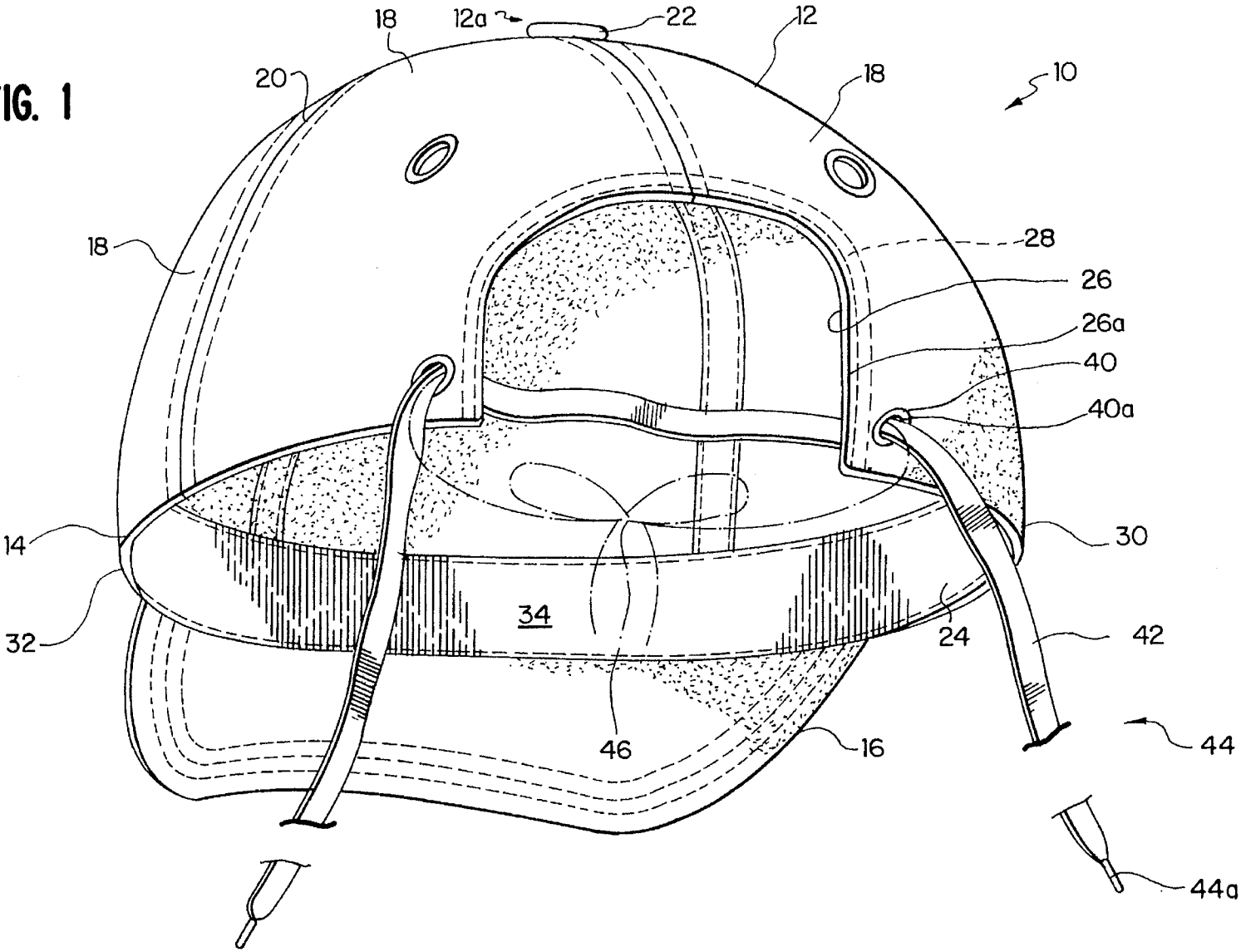
FIG. 1 is a top, rear and right side peripheral view of a baseball-type cap forming a preferred embodiment of the invention.

Referring to the drawings, the present invention as illustrated is directed to a baseball-type cap, although not limited thereto, indicated generally at 10 and formed principally of a shell 12 of general hemispherical shape open at the bottom and forming a peripheral bottom edge 14 and having fixed to that bottom edge 14 and projecting outwardly therefrom at right angles perpendicular to the edge a visor 16 of crescent plan shape. The shell is formed of arcuate cloth segments 18 which are sewn together at confronting edges as at 20 and which segments extend from the bottom peripheral edge 14 of the shell to the top 12*a*, from which projects a button 22 at the center of the shell 12. Preferably, a narrow circular hatband 24 is sewn or otherwise fixed to the inside of the shell segments 18 along the bottom peripheral edge 14. The rear of the shell 12 is open in the form of an arcuate opening 26 provided within adjacent segments 18 of the shell diametrically opposite from visor 16. A narrow ribbon or trim strip 28 may be sewn into the shell 12 along the peripheral edge 26*a* of the opening on the inside surface of the adjacent shell segments 18 at the rear of the shell. The opposite sides 30, 32 of the shell rearwardly of the visor 16 carry the major portion of hatband 24, along with the front 34 of the shell. As may be appreciated, such baseball-type cap may have the shell 12 formed of soft flexible cloth segments, while typically the visor is formed of a rigid molded plastic, or of the same cloth material as covering the top and bottom surfaces of a crescent-shaped cardboard or other relatively rigid insert or core. As such, the visor may be sewn into or otherwise coupled to the shell at its bottom peripheral edge 14, extending from one side 30 to the other 32, and being centered at front 34 of the shell.

An important aspect of the present invention is the incorporation of a pair of metal or plastic grommets 40 into adjacent rear segments 18 of shell 12, preferably at the level of the hatband 24 and being fixedly mounted thereto to prevent the grommets from being pulled out of the shell segments 18 during use and over the lifetime of the cap 10. The grommets 40 are of hollow ring form and thus provided with axial openings 40*a*. The grommets are at opposite corners of the rear shell segments 18 adjacent to the rear opening edge 26*a*.

The infinite adjustability of the cap size is effected by the incorporation of the second principal element of the adjustable size system indicated generally at 42 and comprised of a suitable, elongated, flexible lace 44. The lace may consist of a piece of round cord, alternatively it may be a flat strand of rectangular cross-section such as a tape. The system 42 is quite simple but highly effective. The free ends 44*a* of the lace are preferably tied into a bow 46, i.e., a knot which is easily releasable for retying to conform the hat to the size of the user's head. Once tied, the same user simply fits the cap to the user's head, time-after-time, without retying the bow 46.

As may be appreciated, the materials forming the two basic components of the baseball-style cap 10 in which the illustrated cap has a shell 12 formed of cloth, and particularly segments 18 sewn together and the visor 16 of a plastic or laminated structure having a rigid or semi-rigid core with the cloth top and bottom cover may be other than that illustrated without departing from the invention.

Although the present invention has been described with a certain degree of particularity with respect to a preferred embodiment, it should be understood that changes in detail or structure may be made without departing from the spirit of the invention as defined in the claims appended hereto.

What is claimed is:

1. A baseball-type cap comprising:

an open bottom hemispherical shell having a front, a rear, a top, a bottom and a peripheral bottom edge, a crescent-shaped visor attached to said shell along said peripheral edge at the front of said shell and extending from one side of said shell to another opposite side and projecting perpendicular to said shell, an inwardly and upwardly tapered inverted U-shaped opening in said shell at said rear, said inverted U-shaped opening extending from the bottom of said shell towards the top, diametrically opposite from said visor, grommets in said shell located adjacent opposite sides of said inverted U-shaped opening proximate to said peripheral bottom edge, said grommets having axial holes therein and a lace looped through said grommets and having opposite free ends tied together by a knot to permit an infinite circumferential size adjustment of said shell to conform the shell to the head of a wearer.

2. The loose baseball-type cap as claimed in claim 1, wherein said tied knot is a bow.

3. The loose baseball-type cap as claimed in claim 2, wherein said lace is an elongated cord of circular cross-section.

4. The loose baseball-type cap as claimed in claim 1, wherein said lace is an elongated cord of circular cross-section.

* * * * *